US008154839B2

(12) United States Patent
Stenström et al.

(10) Patent No.: US 8,154,839 B2
(45) Date of Patent: Apr. 10, 2012

(54) HIGH VOLTAGE SURGE ARRESTER AND METHOD OF OPERATING THE SAME

(75) Inventors: Lennart Stenström, Ludvika (SE); Pär Barkensjö, Ludvika (SE)

(73) Assignee: ABB Technology AG (CH)

( * ) Notice: Subject to any disclaimer, the term of this patent is extended or adjusted under 35 U.S.C. 154(b) by 0 days.

(21) Appl. No.: 12/828,663

(22) Filed: Jul. 1, 2010

(65) Prior Publication Data

US 2010/0265623 A1 Oct. 21, 2010

Related U.S. Application Data

(63) Continuation of application No. PCT/EP2009/050686, filed on Jan. 22, 2009.

(30) Foreign Application Priority Data

Jan. 24, 2008 (EP) ..... 08100867

(51) Int. Cl.
*H01H 33/16* (2006.01)
*H01B 17/28* (2006.01)

(52) U.S. Cl. ..... 361/117; 361/112; 361/111; 338/21

(58) Field of Classification Search ..... 361/117, 361/112, 111; 338/21
See application file for complete search history.

(56) References Cited

U.S. PATENT DOCUMENTS

| | | | | |
|---|---|---|---|---|
| 2,522,980 | A * | 9/1950 | Aitchison et al. | 174/562 |
| 3,513,354 | A * | 5/1970 | Sakshaug et al. | 361/129 |
| 3,692,928 | A * | 9/1972 | Friedrich | 174/143 |
| 3,733,521 | A | 5/1973 | Kalb | |
| 3,859,569 | A | 1/1975 | Kresge | |
| 3,963,965 | A * | 6/1976 | Kunkle | 361/130 |
| 5,218,508 | A * | 6/1993 | Doone | 361/127 |
| 5,235,147 | A * | 8/1993 | Pham et al. | 218/144 |
| 5,444,429 | A * | 8/1995 | Sakich et al. | 338/21 |
| 5,680,289 | A * | 10/1997 | Robinson et al. | 361/127 |
| 7,586,729 | B2 * | 9/2009 | Gohler et al. | 361/127 |

FOREIGN PATENT DOCUMENTS

| | | |
|---|---|---|
| EP | 0050723 B1 | 1/1987 |
| GB | 1406782 A | 9/1975 |

OTHER PUBLICATIONS

International Search Report and Written Opinion of the International Searching Authority; PCT/EP2009/050686; Mar. 12, 2009; 12 pages.

* cited by examiner

*Primary Examiner* — Jared Fureman
*Assistant Examiner* — Zeev V Kitov
(74) *Attorney, Agent, or Firm* — St. Onge Steward Johnston & Reens LLC

(57) ABSTRACT

An arrester includes at least one elongate outer first housing made of an electrically insulating material, a pair of electrical terminals at opposite ends of the first housing, an array of electrical components arranged in the first housing that form a series path between the terminals, and a voltage grading arrangement for providing a substantially uniform voltage gradient along the arrester, wherein the voltage grading arrangement includes (i) an elongated outer second housing, and (ii) capacitor circuitry arranged in the outer second housing, and wherein the outer second housing is arranged external to the outer first housing.

15 Claims, 1 Drawing Sheet

HIGH VOLTAGE SURGE ARRESTER AND METHOD OF OPERATING THE SAME

CROSS-REFERENCE TO RELATED APPLICATIONS

The present application is a continuation of pending International patent application PCT/EP2009/050686 filed on Jan. 22, 2009, which designates the United States and claims priority from European patent application number 08100867.4 filed on Jan. 24, 2008, the content of which is incorporated herein by reference.

FIELD OF THE INVENTION

The present invention relates generally to high voltage electrical power equipment. More particularly, the invention relates to surge or lightning arresters and to methods of operating the same.

BACKGROUND OF THE INVENTION

Under normal operating conditions, electrical transmission and distribution equipment is subject to voltages within a relatively narrow range. Due to lightning strikes, switching surges or other system disturbances, portions of the electrical network may experience momentary or transient voltage levels that greatly exceed the levels experienced by the equipment during normal operating conditions. Left unprotected, critical and costly equipment such as transformers, switching apparatus, computer equipment, and electrical machinery may be damaged or destroyed by such over-voltages and the resultant current surges. Accordingly, it is routine practice to protect such apparatus from dangerous over-voltages through the use of surge arresters.

A surge arrester is a protective device that is commonly connected in parallel with a comparatively expensive piece of electrical equipment so as to limit overvoltages and shunt or divert the over-voltage induced current surges safely around the equipment, thereby protecting the equipment and its internal circuitry from damage. When caused to operate, a surge arrester forms a current path to ground having very low impedance relative to the impedance of the equipment that it is protecting. In this way, current surges which otherwise would give high overvoltages across the equipment would be diverted through the arrester to ground.

Conventional surge arresters typically include an elongate outer housing made of an electrically insulating material (porcelain or nowadays more commonly polymer), a pair of electrical terminals at opposite ends of the housing for connecting the arrester between a line-potential conductor and ground, and an array of electrical components in the housing that form a series path between the terminals. These components typically include a stack of voltage-dependent, nonlinear resistive elements. These nonlinear resistors or varistors are characterized by having a relatively high resistance at the normal steady-state voltage and a much lower dynamic resistance when the arrester is subjected to transient overvoltages. Depending on the type of arrester, it may also include one or more electrodes, heat sinks or spark gap assemblies housed within the insulated housing and electrically in series with the varistors.

A substantially uniform voltage gradient along the arrester connected to a high tension terminal is obtained by using grading rings or within the arrester housing using a high number of small capacitors which are connected physically and electrically in parallel to the nonlinear resistive elements.

SUMMARY OF THE INVENTION

A problem with the grading rings is that they are bulky and occupy a rather large area since they need to have large diameters, particularly for ultra high voltage arresters. Further, to obtain an approximately linear voltage distribution the grading rings must hang down approximately ⅓ of the arrester height. Taking into account the necessary clearance to ground the height of the arrester thus has to be about 50% taller than if the arrester could be designed without a grading ring. For instance, for an arrester for a 1200 kV system a required switching surge withstands voltage is approximately 1850 kV, which requires a clearance of around 8.5 m. The use of grading rings will thus require approximately a 13 m high arrester.

A problem with using the internal capacitors is that the high capacitance need leads to circuits with a high number of capacitors, and as the number of component increases the reliability of the arrester decreases.

Accordingly, it is an object of the present invention to provide an arrester for electrical power distribution equipment which is to be connected in parallel with a piece of electrical equipment so as to shunt or divert the over-voltage induced current surges safely around the equipment, thereby protecting the equipment and its internal circuitry from damage, which avoids or at least alleviates at least some of the problems associated with the prior art approaches.

It is in this respect a particular object of the invention to provide such an arrester, which is efficient, reliable, and inexpensive, and which is not bulky or space demanding.

It is a further object of the invention to provide a method of operating an arrester, which fulfills the above objects.

These objects among others are, according to the present invention, attained by arresters and methods of operating an arrester as claimed in the appended patent claims.

According to one aspect of the invention the arrester includes at least one elongate outer first housing made of an electrically insulating material, a pair of electrical terminals at opposite ends of the first housing for connecting the arrester between a line-potential conductor and ground, an array of electrical components arranged in the first housing that form a series path between the terminals, and a voltage grading arrangement for providing a substantially uniform voltage gradient along the arrester, wherein the voltage grading arrangement comprises an elongated outer second housing and capacitor circuitry arranged in the outer second housing, and wherein the outer second housing is arranged external to the outer first housing.

By the provision of such arrester the bulky and large diameter grading rings can be dispensed with. Further, the arrester can be made considerably shorter while maintaining the necessary insulation strength. Yet further, the capacitors of the arrester can be provided with high capacitance to provide a reliable operation of the same.

In one embodiment the arrester includes a plurality of first housings and a plurality of arrays of electrical components, each of which being housed in a respective one of the outer first housings, wherein the first housings are parallel to one another and the arrays of electrical components are connected in parallel.

Preferably, the first and second housings are parallel to one another, and yet preferably the second housing (which houses the capacitor circuitry) is arranged along a central axis of the arrester and the first housings are arranged regularly (with equal distance between the housings) around the central axis at a given distance from the central axis.

According to a second aspect of the invention there is provided a method of operating an arrester for high voltage electrical power equipment comprising at least one elongate outer first housing made of an electrically insulating material, a pair of electrical terminals at opposite ends of the first housing, and an array of electrical components arranged in the first housing that form a series path between the terminals. According to the method the arrester is connected in parallel with a piece of electrical equipment so as to shunt or divert the over-voltage induced current surges safely around the equipment, thereby protecting the equipment and its internal circuitry from damage, wherein a substantially uniform voltage gradient along the arrester is provided by means of a voltage grading arrangement comprising an elongated outer second housing arranged external to the outer first housing, and capacitor circuitry arranged in the outer second housing.

Further characteristics of the invention and advantages thereof will be evident from the following detailed description of embodiments of the invention.

DETAILED DESCRIPTION OF THE INVENTION

Figure 1:
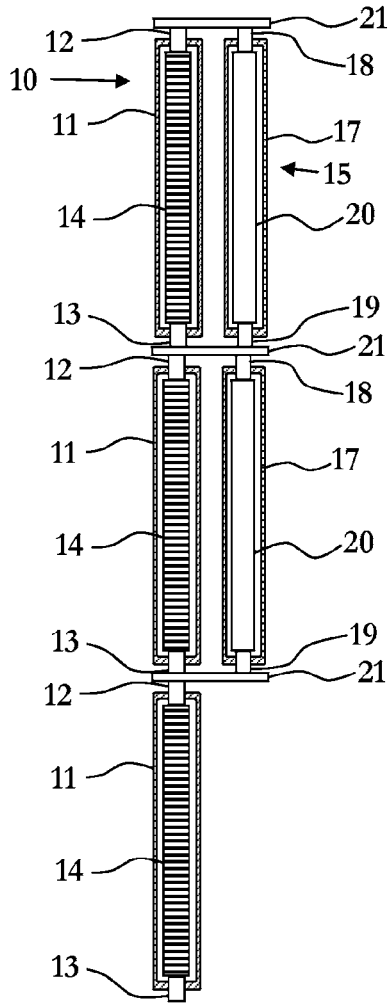
FIG. 1 illustrates schematically in a side elevation view an arrester according to an embodiment of the present invention.

With reference to FIG. 1 a surge or lightning arrester for electrical power distribution equipment according to an embodiment of the invention is connectable in parallel with a piece of electrical equipment so as to limit overvoltages and shunt or divert the over-voltage induced current surges safely around the equipment, thereby protecting the equipment and its internal circuitry from damage.

The arrester is primarily intended for UHV (ultra high voltage) electrical power equipment, that is, equipment for a.c. 3-phase systems with a system voltage above 800 kV.

The arrester, which is typically of the type suitable for open-air installation, particularly suspending open-air installation, comprises an arrester column 10 including typically a plurality of arrester modules arranged on top of one another to form the column. Each arrester module is typically 1-2 m in height and includes an elongate outer housing 11 made of an electrically insulating material, a pair of electrical terminals 12, 13 at opposite ends of the housing 11, and an array of electrical components 14 arranged in the housing 11 that form a series path between the terminals 12, 13. The array of electrical components 14 includes advantageously a large number of varistor blocks.

While the arrester column 10 of FIG. 1 is shown as having three arrester modules connected in series, there is no limitation in this respect. Typically, an arrester of the present invention has more than three arrester modules.

Further, the arrester comprises a voltage grading arrangement 15 for providing a substantially uniform voltage gradient along the arrester. According to the invention the voltage grading arrangement comprises at least one voltage grading module including an elongated outer housing 17 made of an electrically insulating material, a pair of electrical terminals 18, 19 at opposite ends of the housing 17, and capacitor circuitry 20 arranged in the outer housing 17 of the voltage grading module that form a series path between the terminals 18, 19. In FIG. 1 two voltage grading modules are shown arranged on top of one another to form a voltage grading column 15.

The outer housings 11 of the arrester column 10 and the outer housings 17 of the voltage grading column 15 are arranged externally with respect to one another. Preferably, the arrester column 10 and the voltage grading column 15 are arranged parallel with each other with a suitable spacing in between.

Further the arrester of FIG. 1 comprises a plurality of connecting metal plates 21 provided for interconnecting the array of electrical components 14 and the capacitor circuitry 20 at each of the ends of the arrester modules and the voltage grading modules. Thus, the interconnections are made at a plurality of positions along the height of the arrester.

In another embodiment of the invention (not illustrated) only one (or a few) arrester module(s) and one capacitor module of the kind described with reference to FIG. 1 are arranged parallel and adjacent one another.

Figure 2:
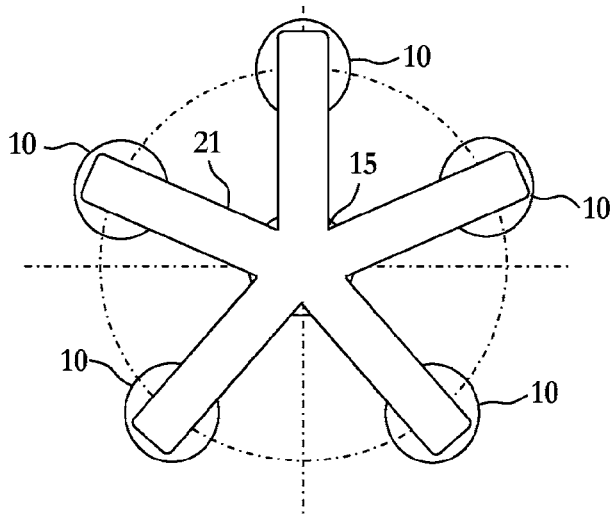
FIG. 2 illustrates schematically in a top view an arrester according to another embodiment of the present invention.

FIG. 2 illustrates schematically in a top view an arrester according to still another embodiment of the present invention. Here the arrester comprises a plurality of arrester columns 10 arranged in parallel and regularly around a centrally located voltage grading column 15 of the kind described with reference to FIG. 1. Preferably, the voltage grading column 15 is arranged along a central axis of the arrester and the arrester columns 10 are arranged equidistantly along the circumference of a circle arranged concentrically with the central axis.

Connecting metal plates 21 interconnect the arrester columns 10 and the voltage grading column 15 in parallel at a number of heights, dividing up the arrester vertically in the separate modules as shown in FIG. 1. In FIG. 2 are shown five arrester columns 10, but there may be more or less depending on the application and dimensioning of the individual arrester modules. The voltage grading column 15 may contain one or more voltage grading modules and may be manufactured with a length corresponding to one, two or more arrester modules in series.

A plurality of arrester columns may be required to meet high requirements on energy capability and low protection levels.

By the present invention an arrester can be made considerably shorter in height, less bulky, and of lighter weight as compared to the prior art solutions using grading rings while maintaining a high reliability.

Low weight is extremely important in order to limit mechanical loads on the arrester. In addition, higher capacitance values than usually used for grading could be applied which would improve the protection performance of the arrester since the steepness of occurring surges could be reduced. Additional benefit will be that the phase-to-phase spacings could be shorter since the diameters of corona rings are less than diameters of grading rings.

What is claimed is:

1. An arrester for electrical power distribution equipment provided for being connected in parallel with a piece of electrical equipment so as to limit overvoltages and shunt or divert over-voltage induced current surges safely around the equipment, thereby protecting the equipment and its internal circuitry from damage, said arrester including at least one elongate outer first housing made of an electrically insulating material, a pair of electrical terminals at opposite ends of the first housing, an array of electrical components arranged in the first housing that form a series path between the terminals, and a voltage grading arrangement comprising an elongated outer second housing, and capacitor circuitry arranged in said outer second housing, said outer second housing is arranged external to said outer first housing, and said outer first housing is arranged as a first arrester module and said outer second housing is arranged as a first grading module, wherein the first arrester module and the first grading module are detachable from each other, so as to provide for adjustment to provide a substantially uniform voltage gradient.

2. The arrester of claim 1 wherein said first and second housings are parallel to one another.

3. The arrester of claim 1 comprising a connecting metal plate provided for interconnecting the array of electrical components and the capacitor circuitry.

4. The arrester of claim 1 comprising a plurality of said first housings and a plurality of said arrays of electrical components, each of which being housed in a respective one of the plurality of said first housings, wherein the plurality of said first housings are arranged on top of one another and the plurality of said arrays of electrical components are connected in series.

5. The arrester of claim 4 comprising a plurality of said second housings and a plurality of said capacitor circuitries, each of which being housed in a respective one of the plurality of said second housings, wherein the plurality of said second housings are arranged on top of one another and the plurality of said capacitor circuitries are connected in series.

6. The arrester of claim 5 comprising a plurality of connecting metal plates provided for interconnecting the plurality of said arrays of electrical components and the plurality of said capacitor circuitries at a plurality of positions along said arrester.

7. The arrester of claim 1 comprising a plurality of said first housings and a plurality of said arrays of electrical components, each of which being housed in a respective one of the plurality of said first housings, wherein the plurality of said first housings are parallel to one another and the plurality of said arrays of electrical components are connected in parallel.

8. The arrester of claim 7 wherein said second housing is arranged along a central axis of said arrester and the plurality of said first housings are arranged around said central axis.

9. The arrester of claim 1 wherein said first and second housings are made of a polymer.

10. The arrester of claim 1 wherein said arrester is provided for UHV electrical power equipment.

11. A method of operating an arrester for electrical power equipment comprising at least one elongate outer first housing made of an electrically insulating material, a pair of electrical terminals at opposite ends of the first housing, and an array of electrical components arranged in the first housing that form a series path between the terminals, the method comprising the step of:

connecting the arrester in parallel with a piece of electrical equipment so as to limit overvoltages and shunt or divert over-voltage induced current surges safely around the equipment, thereby protecting the equipment and its internal circuitry from damage, and being characterized by the step of:

providing a voltage grading arrangement comprising an elongated outer second housing arranged external to said outer first housing, and capacitor circuitry arranged in said outer second housing, wherein the outer first housing is arranged as a first arrester module and the outer second housing is arranged as a first grading module, and the first arrester module and the first grading module are detachable from each other, so as to provide for adjustment to provide a substantially uniform voltage gradient.

12. The method of claim 11 wherein said method is performed on an arrester for UHV electrical power equipment.

13. The arrester of claim 1 further comprising a second arrester module connected in series with said first arrester module.

14. The arrester of claim 13 further comprising a third arrester module connected in series with said second arrester module.

15. The arrester of claim 13 further comprising a second grading module connected in series with said first grading module.

* * * * *